United States Patent [19]

Bourgeois et al.

[11] Patent Number: 5,000,408

[45] Date of Patent: Mar. 19, 1991

[54] SUPPORT FOR AN ANTENNA OF THE AZIMUTH-ELEVATION TYPE

[75] Inventors: Alain Bourgeois, Eaubonne; Eric Begout, Nogent-sur-Marne; Eric Chauvin, Moissey; Raymond Gueuret, Nanterre; Pascal Lapeyre, Ermont, all of France

[73] Assignee: Alcattel Transmission Par F.H., France

[21] Appl. No.: 425,131

[22] Filed: Oct. 23, 1989

[30] Foreign Application Priority Data

Oct. 21, 1988 [FR] France ..... 88 13825

[51] Int. Cl.[5] ..... H01Q 19/00

[52] U.S. Cl. ..... 248/183; 343/882; 248/230

[58] Field of Search ..... 248/183, 425, 186, 230, 248/664; 343/880, 881, 878, 871, 882

[56] References Cited

U.S. PATENT DOCUMENTS

| | | | |
|---|---|---|---|
| 3,167,292 | 1/1965 | Meyerowitz | 248/230 |
| 3,391,889 | 7/1968 | Stewart, Jr. | 248/230 |
| 4,617,572 | 10/1986 | Hugo | 248/183 X |
| 4,626,864 | 12/1986 | Micklethwaite | 248/183 X |
| 4,659,044 | 4/1987 | Armstrong . | |
| 4,819,007 | 4/1989 | Tezcan | 343/880 X |

FOREIGN PATENT DOCUMENTS

| | | | |
|---|---|---|---|
| 1023093 | 7/1958 | Fed. Rep. of Germany . | |
| 986271 | 5/1968 | Fed. Rep. of Germany . | |
| 3530809 | 3/1987 | Fed. Rep. of Germany | 343/882 |
| 0075103 | 4/1985 | Japan | 343/878 |

OTHER PUBLICATIONS

S. Hildebrand, "Feinmechanische Bauelemente", 3rd edition; 1967, VEB Verlag Berlin.

*Primary Examiner*—Karen J. Chotkowski
*Attorney, Agent, or Firm*—Sughrue, Mion, Zinn, Macpeak & Seas

[57] ABSTRACT

An azimuth-elevation type antenna support comprising a stock and a mounting plate on which the antenna is fixed, the support being mounted on a base relative to which the antenna takes up a cantilevered position, the support being characterized in that the stock (31) comprises: at least one top half-collar (41) disposed around the base (10) and having its arms (46) extending towards the antenna, with a top strap (42) fixed to the top half-collar (41) in order to lock it on the base; a bottom half-collar (43) disposed around the base and having its arms (47) extending away from the antenna, with a bottom strap (44) fixed to the bottom half-collar (43) in order to lock it on the base; and two side risers (45) extending over a certain distance parallel to the axis of the base and each interconnecting the end portion of one of the arms (46) of the top half-collar (41) to the end portion of the bottom half-collar (43) located therebelow.

5 Claims, 6 Drawing Sheets

SUPPORT FOR AN ANTENNA OF THE AZIMUTH-ELEVATION TYPE

The present invention relates to a mount for an antenna, and more particularly to a mount of the azimuth-elevation type, i.e. a mount having a vertical axis of rotation for pointing the antenna in azimuth, and a horizontal axis of rotation for pointing the antenna in elevation.

BACKGROUND OF THE INVENTION

The invention relates more particularly to an antenna of the azimuth-elevation type cantilevered out from a vertical post. In such a case, the antenna support which is a part mounted on a vertical base and which allows the antenna to rotate in azimuth, poses a problem. It must be capable of being released relative to the base in order to allow rotation to take place. Thereafter it must be fixed to the base in order to prevent any azimuth rotation of the antenna once correctly aimed. In both of these two situations, the elevation angle of the antenna must not change. Otherwise any azimuth correction will also require an elevation correction, and this considerably complicates the work of the person setting up the antenna. An antenna support is conventionally constituted essentially by a split cylindrical part and cannot satisfy this requirement since any clearance provided to enable azimuth rotation to take place also allows the cylindrical part to tilt relative to the base, thus altering elevation.

The object of the invention is therefore to provide an antenna support including means for keeping the antenna elevation the same regardless of whether it is free or fixed relative to the base.

SUMMARY OF THE INVENTION

According to the invention, the antenna support comprises: a mounting plate to which both the antenna and a stock are fixed, said stock comprising at least one top half-collar disposed around the base and having its arms extending towards the antenna, with a top strap fixed to the top half-collar in order to lock it on the base; a bottom half-collar disposed around the base and having its arms extending away from the antenna, with a bottom strap fixed to the bottom half-collar in order to lock it on the base; and two side risers extending over a certain distance parallel to the axis of the base and each interconnecting the end portion of one of the arms of the top half-collar to the end portion of the bottom half-collar located therebelow.

According to another feature of the invention, each of the half-collars extends around about 180° of the base.

According to another feature of the invention, each of the half-collars includes at least one internal cylindrical bearing surface of limited height and angular extent.

According to another feature of the invention, each of the half-collar includes two cylindrical bearing surfaces symmetrically disposed relative to its arms and at an angular spacing of about 90°.

According to another feature of the invention, the antenna suport is constituted, apart from the two straps, essentially by a metal casting with only said bearing sufaces in the half-collars being machined.

The dispositions described above enable the support in place on the base and loaded by a cantilevered antenna to be subjected to forces in such a manner that the bearing surfaces provided on the inside surfaces of the half-collars remain pressed against the cylindrical surface of the base, regardless of whether the straps are clamped tight or not, thereby ensuring that the elevation of the antenna remains unchanged and retains its fixed value while azimuth is being adjusted.

BRIEF DESCRIPTION OF THE DRAWINGS

An embodiment of the invention is described by way of example with reference to the accompanying drawings, in which.

DETAILED DESCRIPTION

Figure 1:
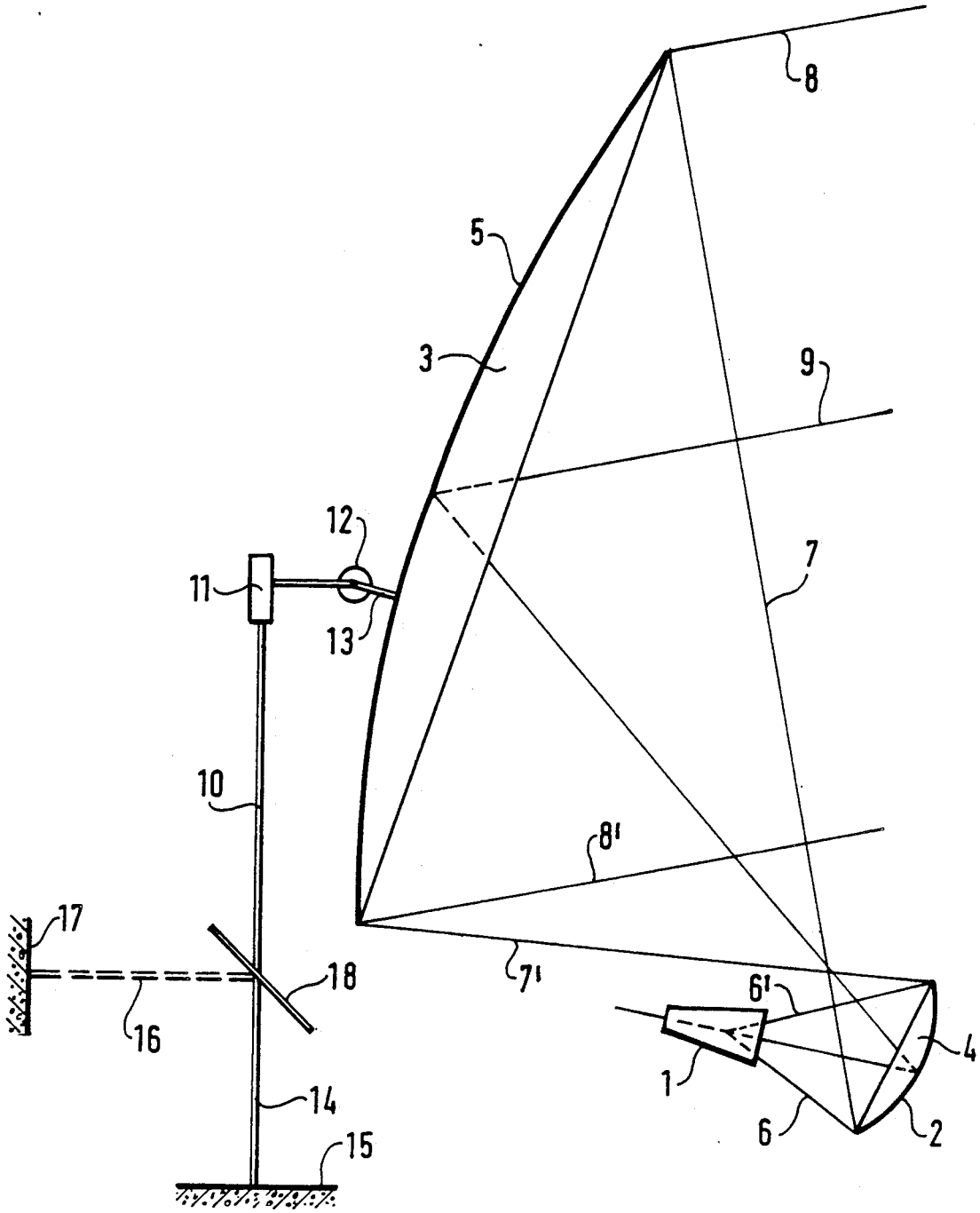
FIG. 1 is a simplified view of an elevation-azimuth type of antenna mount for use with an antenna having an eccentric source.

The description begins with reference to FIG. 1 which is a simplified diagram of an azimuth-elevation type of antenna, for the case where the antenna has an eccentric source.

The antenna per se comprises a source 1 illuminating an auxiliary reflector 2 which in turn illuminates a main reflector 3. The curvature and dimensions of the reflecting surfaces 4 and 5 are such that the auxiliary reflector 2 receives as much as possible of the entire radiation 6—6' coming from the source 1 and converts it into radiation 7—7' which is uniform over the entire area of the main reflector 3, which in turn converts it into a parallel beam 8—8' having the best possible polarization characteristics.

The radiation axis 9 of the antenna is fixed relative to these components whose dispositions, in the antenna shown, are likewise fixed. Antenna aiming thus consists in using an antenna mount to move the unitary structure constituted by the two reflectors and the source.

FIG. 1 shows an azimuth-elevation type of antenna mount. The mount comprises a vertical base 10 onto which an antenna support 11 is mounted which in turn carries the antenna structure symbolized at 13 via an elevation hinge 12.

The antenna support 11 is mounted on the base 10 so as to be capable of pivoting about the vertical axis of the base. The antenna can thus rotate in a horizontal plane, at least within certain limits. It is thus aimed in the appropriate direction. When accurate magnetic or geographical references are not available, such aiming generally requires to be adjusted on site.

The antenna structure 13 is mounted on the antenna support 11 via a hinge 12 allowing rotation about a horizontal axis. The antenna can thus be aimed with the desired elevation. This is generally known accurately when the antenna is to be aimed at a given communications satellite.

The base 10 may be extended rectilinearly by a leg 14 standing on a horizontal surface 15. Alternatively it may be extended by a substantially horizontal leg 16 fixed on a vertical surface 17. The connection between the base 10 and the leg 16 may be preformed via a pair of plates 18 at 45° to each other. The base 10 can thus be fixed to any available surface in such a manner as to ensure that its axis is accurately vertical.

Once the angle of elevation of the antenna has been adjusted, as mentioned above, the antenna support must allow the antenna to be rotated in azimuth and then locked in a selected azimuth without changing its elevation. An antenna support designed in accordance with the invention in order to enable this result to be achieved is now described with reference initially to FIG. 2.

Figure 2:
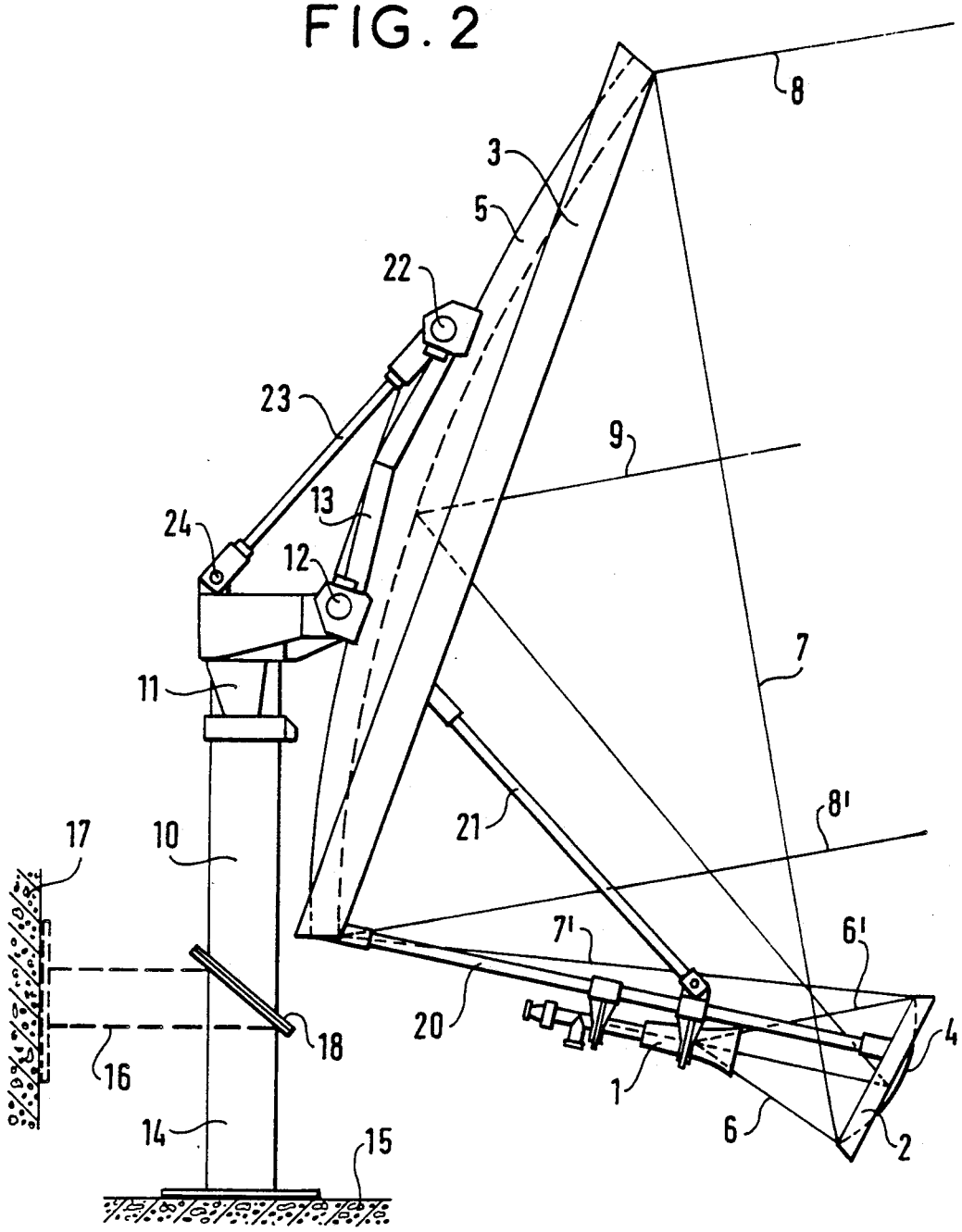
FIG. 2 is a side view of an antenna as shown if FIG. 1, together with an antenna support in accordance with the invention.

The antenna shown in FIG. 2 is the same as the antenna shown in the simplified diagram of FIG. 1, and the same components are given the same references.

The source 1 is carried by a mount including two legs 20 projecting from the bottom of the main reflector 3 and two legs 21 which are also spaced apart. The auxiliary reflector 2 is fixed to the ends of the legs 20 at an appropriate angle.

The surface 5 of the main reflector 3 is carried by a latticework (not shown) to which the structure 13 is fixed. The antenna structure 13, itself contituted by a kind of frame, bears on the reflector-carrying latticework at four points. This structure is carried by the antenna support to which it is fixed via three points: it rotates about two points constituting an elevation hinge 12 and it has an additional hinge point 22 via which it is connected to a tie 23 whose other end is connected to an attachment point 24 on the antenna support 11. The tie 23 is adjustable in length and its length defines the elevation angle of the antenna.

Figure 3:
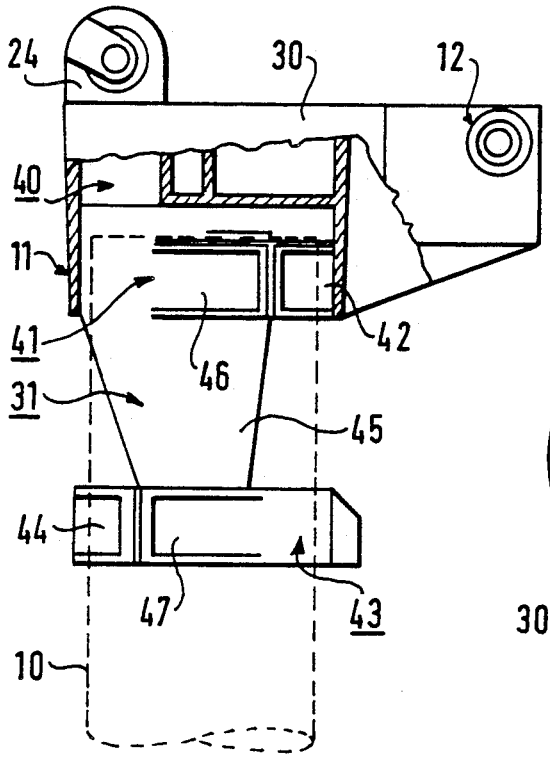
FIGS. 3 and 4 are an elevation view and a plan view of the FIG. 2 antenna support.
Figure 4:
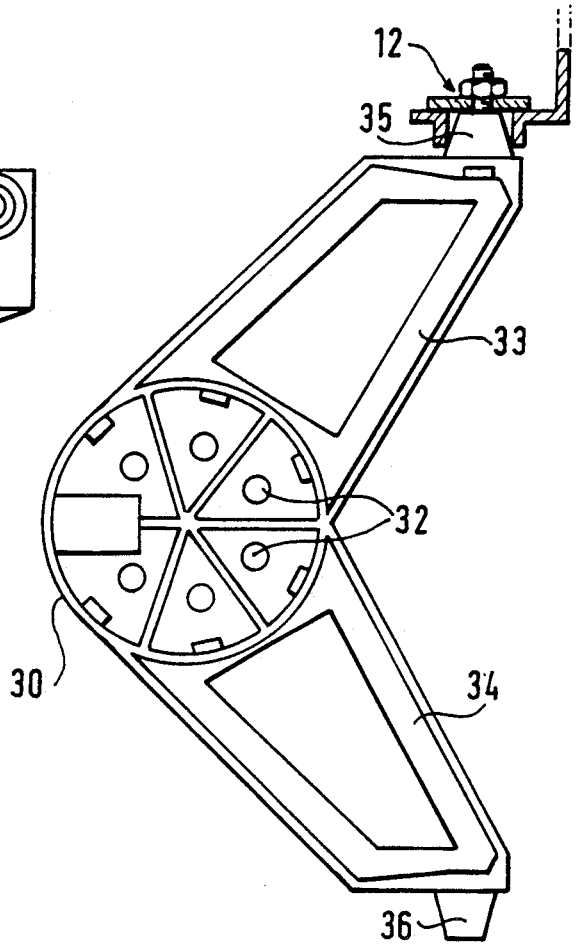

FIGS. 3 and 4 are more detailed figures showing the sturcture of the antenna support of the invention. The support compries two parts which are assemble together: a top part 30 and a stock 31. The top part 30 is shown partially in section in FIG. 3 and as seen from above in FIG. 4. It fits over the stock 31 and it fits thereto bt means of screws, e.g. at 32. The top part 30 constitutes a kind of mounting plate which carries the fixing point 24, e.g. a single pierced lug which engages, for example, a fork terminating the tie 23. The top part is also extended by two wings 33 and 34 each terminated by a respective frustoconical bearing surface 35 or 36 for taking up slack and for constituting the pivot of the hinge 12.

The stock 31 comprises: a slab 40 on which the top portion 30 is fixed; a top half-collar 41 disposed around the base 10 and having its arms 46 extending towards the antenna, with a top strap 42 fixed to the top half-collar 41 in order to lock it on the base 10; a bottom half-collar 43 disposed around the base 10 and having its arms 47 extending away from the antenna, with a bottom strap 44 fixed to the bottom half-collar 43 in order to lock it on the base 10; and two side risers 45 extending over a certain distance parallel to the axis of the base and each interconnecting the end portion of one of the arms 46 of the top half-collar 41 to the end portion of the bottom half-collar 43 located therebelow.

The strap 42 is fixed to half-collar 41 via facing lugs provided on both these two parts and which are interconnected, e.g. by bolts. The geometry of the two parts is such as to enable the assembly to clamp onto the base 10. When the bolts are loosened, the assembly does not oppose rotation.

The strap 44 and the half-collar 43 are organized in the same way.

As shown in FIG. 3, the antenna support is placed on the top end of the base 10. Its load is on the same side as the hinge 12. It draws the half-collar 41 towards the surface of the base 10. Pivoting about this bearing surface, it urges the half-collar 43 against the opposite surface of the base 10. Regardless of whether the straps are tight or loose, this defines the position of the antenna support and consequently the elevation angle of the antenna.

As explained below, the risers 45 do not make contact with the base and do not participate in the effect described above.

Figure 5:
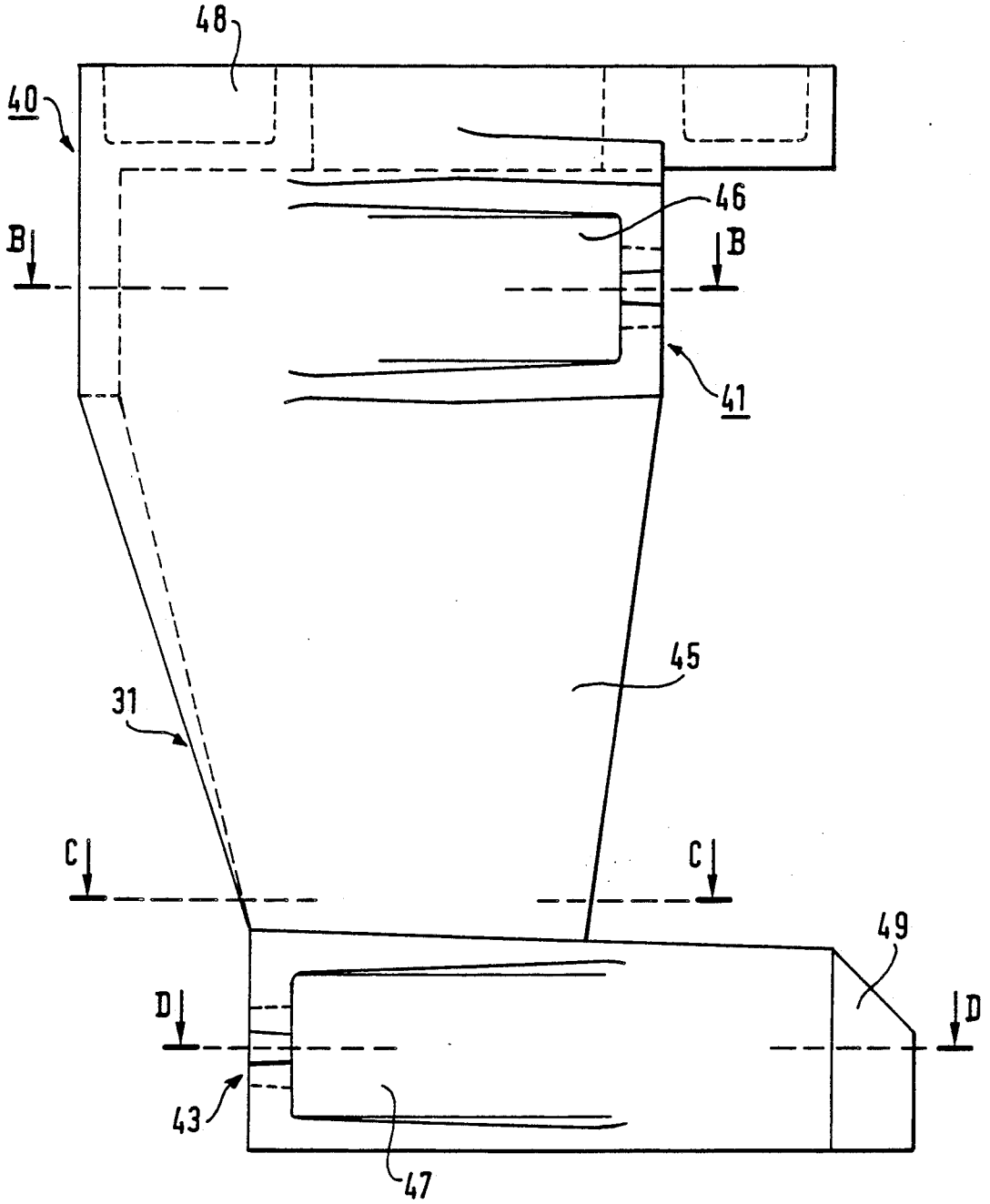
FIGS. 5, 6, and 7 are respectively an elevation view, a section view through the top half-collar on line B—B of FIG. 5, and a pair of half-sections on lines C—C and D—D of FIG. 5, showing details of the antenna support shown in FIGS. 3 and 4.
Figure 6:
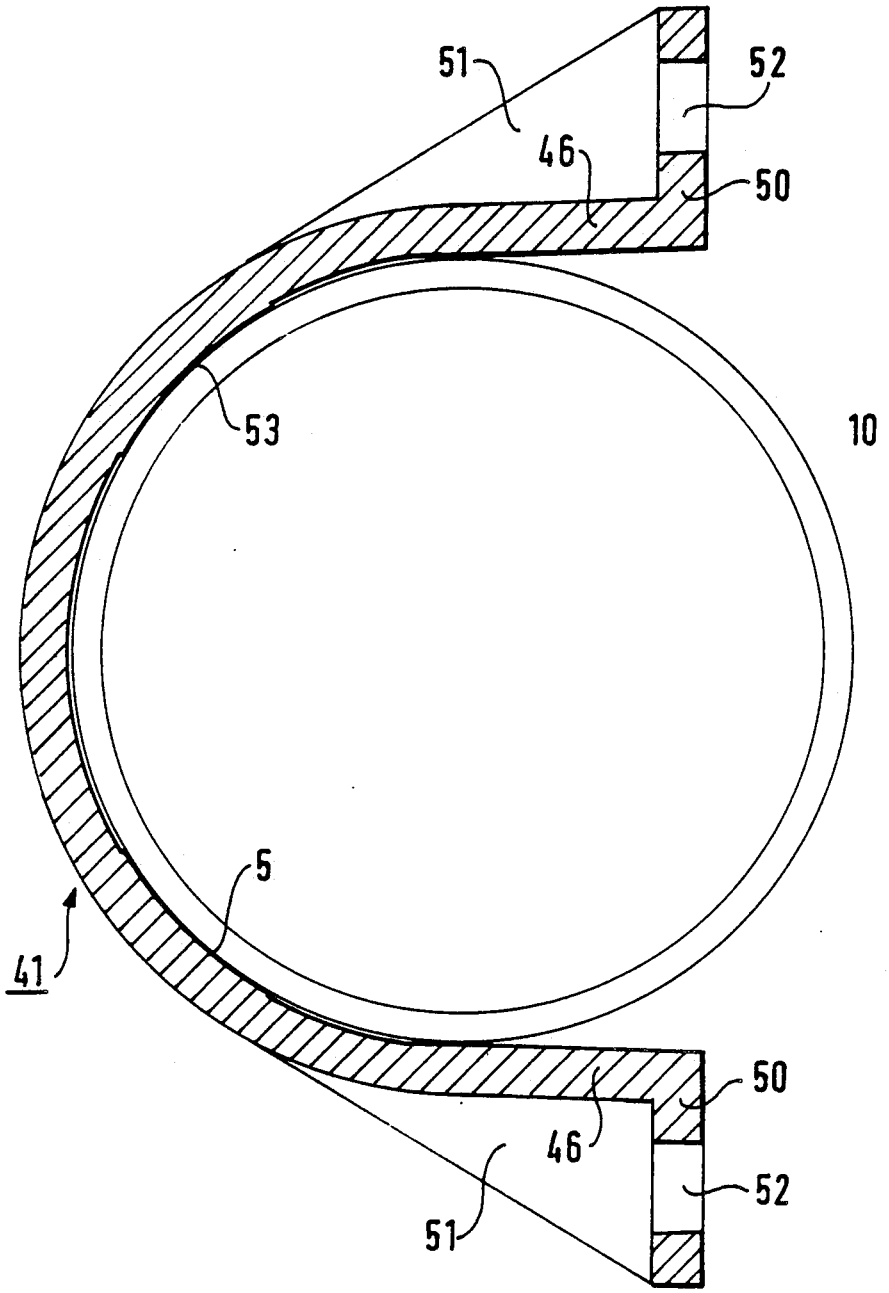
Figure 7:
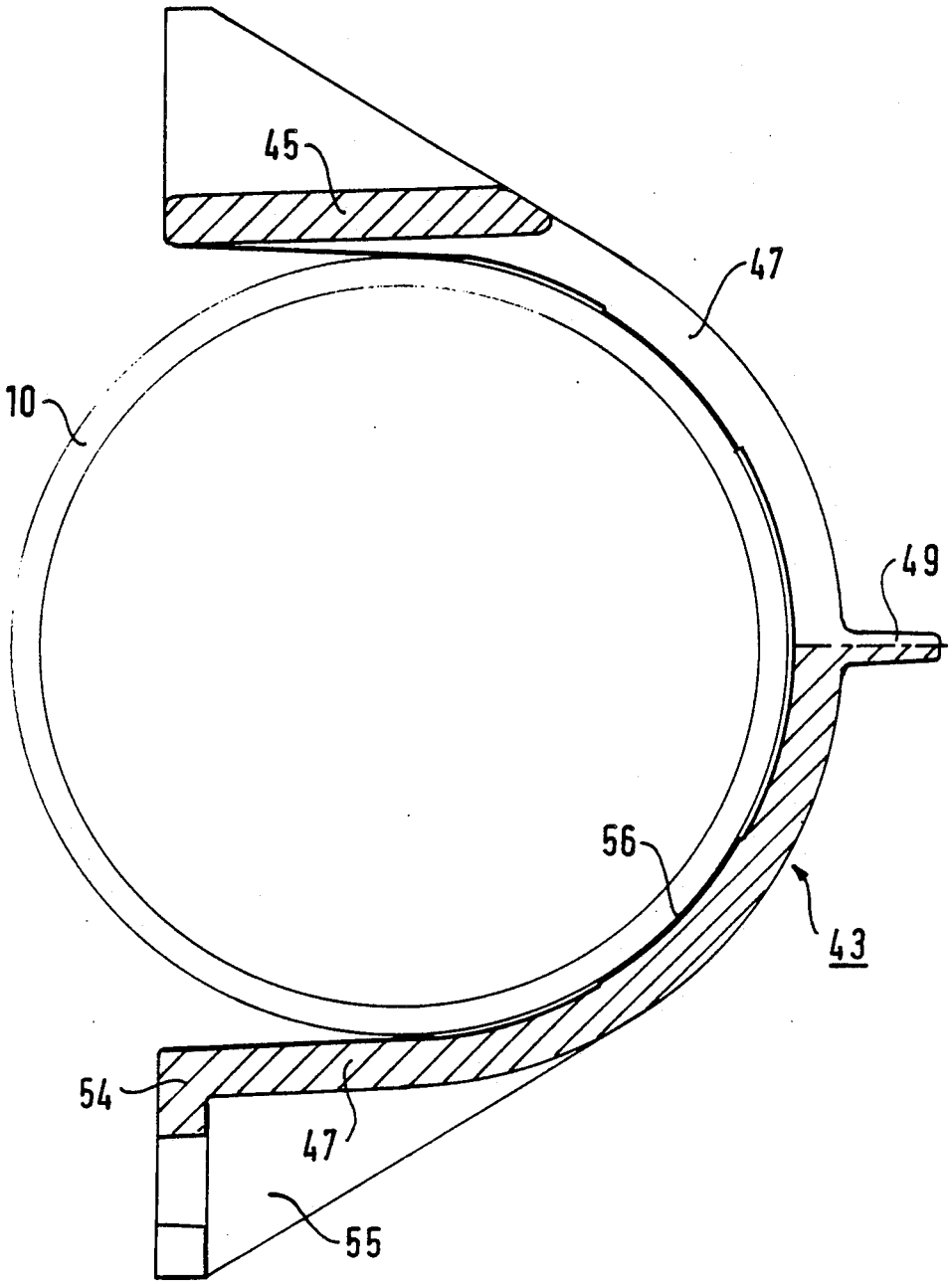

FIGS. 5, 6, and 7 show the antenna support of FIGS. 2, 3, and 4 in greater detail, but without the straps. The same items are given the same references. FIG. 5 shows where the section planes of FIGS. 6 and 7 are located. In addition, it can be seen that the slab 40 has recesses 48 in order to lighten the stock. Half-collar 43 also a fin 49 for pressing against when swivelling the antenna in azimuth.

As can be seen by comparing FIGS. 6 and 7, the two half-collar 41 and 43 face in opposite directions. In FIG. 6 which corresponds to a section on line B—B, half-collar 41 is a part which is semicircular in shape disposed around not more than 180° of the base 10 and having arms 46 which are extended by lugs 50 each supported by at least one reinforcing web 51. The lugs are pierced at 52 in order to pass the above-mentioned clamping blot. The strap 42 (not shown) is conventionally a bridge with the center of its free portion between the arms of the half-collar bearing against the base 10 terminated at either end by lugs facing the lugs 50 and disposed at a distance thereform. The resilience of the strap enables the half-collar to be clamped gradually onto the base. FIG. 6 also shows cylindrical bearing surfaces 52 and 53 via which the half-collar 41 bears against the base 10. These bearing surfaces are internal projections of reduced angular extent, e.g. 30°, of limited height, e.g. less than that of the half-collar, and having cylindrical surfaces that may be machined after casting, thereby improving surface state and dimensional accuracy. Advantageously, two bearing surfaces are provided symmetrically disposed about the direction opposite to the antenna, with a gap between them of 60°, for example.

The bottom half of FIG. 7 corresponding to the section D—D shows that although not strictly necessary, the half-collar 43 is exactly similar to that shown in FIG. 6, with lugs 54, webs 55, and bearing surfaces 56 similar to the above-described portions 50, 51, and 52.

The top half of FIG. 7 is a section on line C—C immediately above half-collar 43. The base of one of the two risers 45 can thus be seen at the end of one of the arms 47, and it can be seen that it is set at a distance from the base 10 so as to avoid having an effect on the position taken up by the antenna support relative to the base. Thus. the position of the support is defined solely by the bearing surfaces 51, 52, and 56 which bear against the base. The stiffness of the risers 45 and the accuracy of the bearing surfaces ensure that the elevation of the antenna is accurately defined and premanently guaranteed regardless of whether the antenna is prevented from rotating or, on the contrary, is released by loosenig the straps. To this end, the antenna support is advantageously contituted in the form of a single casting, as mentioned above, with only its cylindrical bearing surfaces being machined.

Naturally the above description is given purely by way of non-limiting example and numerous variants can be envisaged without going beyond the scope of the invention.

We claim:

1. An azimuth-elevation type antenna support comprising a stock and a mounting plate on which the antenna is fixed, said support being mounted on a base relative to which the antenna takes up a cantilevered position, wherein said stock comprises: at least one top half-collar disposed around the base and having arms extending towards the antenna, a top strap fixed to the top half-collar to lock said half-collar on said base; a bottom half-collar disposed around the base and having arms extending away from the antenna, a bottom strap fixed to the bottom half-collar and locking said bottom half-collar on the base; and two side risers extending over a certain distance parallel to the axis of the base and each side riser interconnecting the end portion of one of the arms of the top half-collar to the end portion of the bottom half-collar located therebelow.

2. An antenna support according to claim 1, wherein each of the half-collar is disposed around about 180° of the base.

3. An antenna support according to claim 1, wherein each of the half-collar includes at least one internal cylindrical bearing surface of height and of angular extent which are less than those of the half-collar.

4. An antenna support according to claim 3, wherein each of the half-collar includes two cylindrical bearing surfaces symmetrically disposed relative to the arms thereof and at an angular spacing of about 90°.

5. An antenna support according to claim 3, wherein the antenna support is constituted, apart from the two straps, essentially by a metal casting, and wherein said half-collar include machined bearing surfaces.

* * * * *